US007775140B2

(12) United States Patent
Chan

(10) Patent No.: US 7,775,140 B2
(45) Date of Patent: Aug. 17, 2010

(54) CORK EXTRACTOR

(75) Inventor: Sik Leung Chan, Tsuen Wan (HK)

(73) Assignee: C.C. & L Company Limited, Tsuen Wan, N.T. (HK)

( * ) Notice: Subject to any disclaimer, the term of this patent is extended or adjusted under 35 U.S.C. 154(b) by 84 days.

(21) Appl. No.: 12/079,852

(22) Filed: Mar. 28, 2008

(65) Prior Publication Data

US 2009/0241737 A1 Oct. 1, 2009

(51) Int. Cl.
*B67B 7/04* (2006.01)

(52) U.S. Cl. ..... 81/3.37; 81/3.33; 81/3.29; 81/3.45

(58) Field of Classification Search ..... 81/3.37, 81/3.33, 3.31, 3.36, 3.29, 3.45, 3.48; D8/42
See application file for complete search history.

(56) References Cited

U.S. PATENT DOCUMENTS

| | | | | |
|---|---|---|---|---|
| 106,036 | A | 8/1870 | Dickson | |
| 344,566 | A | 6/1886 | Cluever | |
| 515,411 | A | 2/1894 | Walker | |
| 814,641 | A | 3/1906 | Coomber | |
| 876,049 | A | 1/1908 | Fialcofsky | |
| 884,873 | A | 4/1908 | Stanton | |
| 4,703,673 | A | 11/1987 | Allen | |
| 5,079,975 | A | 1/1992 | Spencer, Jr. | |
| 5,257,565 | A | 11/1993 | Hung | |
| 5,361,652 | A | 11/1994 | Andina | |
| 5,924,338 | A | 7/1999 | Peck | |
| 5,934,160 | A | 8/1999 | Gibson | |
| 6,073,519 | A | 6/2000 | Presa Eguren | |
| 6,257,092 | B1 | 7/2001 | Gort-Barten | |
| 6,357,322 | B1 * | 3/2002 | Dolan et al. | 81/3.37 |
| 6,622,330 | B2 | 9/2003 | Puig | |
| 6,739,215 | B2 | 5/2004 | Lozeau et al. | |
| 6,978,696 | B2 * | 12/2005 | Yu | 81/3.29 |
| 7,069,813 | B2 | 7/2006 | Cheung | |
| 7,069,825 | B2 | 7/2006 | Cheung | |
| 7,398,709 | B2 * | 7/2008 | Vitrac et al. | 81/3.37 |

(Continued)

FOREIGN PATENT DOCUMENTS

| | | |
|---|---|---|
| DE | 202 19 538 U1 | 3/2003 |

(Continued)

OTHER PUBLICATIONS

Antique & Vintage Corkscrew Guide, Rack & Pinion Corkscrews, a French corkscrew, French Patent No. 112465 known as the Cremailliere. [online]. Oct. 2007 [retrieved on Sep. 9, 2009]. Retrieved form the Internet: <http://corkscrewsonline.com/corkscrew_guide_rack_and_pinion_corkscrews.html>.*

*Primary Examiner*—D. S Meislin
(74) *Attorney, Agent, or Firm*—Daniel P. Burke & Associates, PLLC

(57) ABSTRACT

A cork extractor significantly reduces the countervailing forces that must be applied to a bottle during extraction of a cork by providing a handle having a rotational axis substantially perpendicular to the vertical, longitudinal axis of a cork as it is removed from a bottle. A handle rotates about an axis and comprises gripping portions on opposite sides of the rotational axis. The corkscrew is prevented from spiraling out of the cork during the application of upwardly directed forces independently of the screw carrier.

36 Claims, 17 Drawing Sheets

U.S. PATENT DOCUMENTS

| | | | |
|---|---|---|---|
| 2003/0126953 | A1 | 7/2003 | Kushner |
| 2005/0199097 | A1 | 9/2005 | Soen et al. |
| 2005/0217434 | A1 | 10/2005 | Opolka |
| 2006/0185477 | A1 | 8/2006 | Sun |
| 2007/0089570 | A1 | 4/2007 | Vitrac et al. |
| 2007/0107554 | A1 | 5/2007 | Yeager |
| 2007/0107555 | A1 | 5/2007 | Zhou |

FOREIGN PATENT DOCUMENTS

| | | | |
|---|---|---|---|
| EP | 1 215 165 | A1 | 6/2002 |
| FR | 2 318 103 | | 3/1997 |
| GB | 2 053 867 | A | 2/1981 |
| GB | 2 304 703 | A | 3/1997 |
| GB | 2 399 566 | A | 9/2004 |

* cited by examiner

CORK EXTRACTOR

The present invention relates to cork extractors and, more particularly, to cork extractors which minimize the amount of countervailing force which must be applied to a bottle during cork extraction to offset the force applied to lift a cork out of the bottle.

BACKGROUND

Many types of cork extractors have been previously proposed. Many cork extractors rely upon a lever which, after burying a corkscrew into a cork, requires upward force applied to a lever in order to extract the cork from a bottle. The position of the upwardly directed force relative to the bottle generally requires that an equal and opposite force be applied to the bottle in order to prevent the bottle from moving. Such designs result in wasted effort as countervailing forces must be applied by the user.

While some previous designs of corkscrews have used handles to apply the force necessary to extract a cork from a bottle, to the knowledge of the present inventor, such handles have been in the form of cranks wherein the portion gripped by the person using the device is offset in a single direction from the rotational axis of the crank. Additionally, some such devices utilize a driving mechanism which is at an angle to the vertical axis upon which the cork travels during extraction, thus, also requiring that countervailing forces being applied to the bottle during cork extraction.

Another aspect of some cork extractors is that a corkscrew is driven down through a block containing a helical passageway in order to impart a spiraling movement to the corkscrew. This facilitates insertion of the corkscrew into the cork. Such devices typically comprise a screw carrier. Typically, after insertion of the corkscrew into the cork, such screw carriers are attached to the block containing the helical passageway in order to prevent the corkscrew from simply spiraling back out of the cork during extraction of the cork from the bottle. Such devices which connect a screw carrier to the block containing the helical passageway, for example with releasable latches or friction, are unduly complicated structures and can be unreliable during operation. It would therefore be desirable to provide a cork extractor wherein the tendency of the corkscrew to rotate out of the cork is impeded by structure, which is independent of the screw carrier.

It would also be desirable to provide a cork extractor which minimizes or eliminates the need for forces which countervail the forces being applied to remove the cork from a bottle.

SUMMARY OF THE INVENTION

The various embodiments of the present invention significantly reduce the countervailing forces that must be applied to a bottle during extraction of a cork by providing a handle having a rotational axis substantially perpendicular to the vertical, longitudinal axis of a cork as it is removed from a bottle. The preferred, illustrated handle of the present invention comprises gripping portions on opposite sides of the rotational axis of the handle. This design is designed to receive a couple, i.e. a pair of equal, parallel forces acting in opposite directions and tending to produce rotation. Thus, this design maximizes the use of the forces applied to the handle for cork extraction and reduces the countervailing forces which need to be applied to a bottle or other container during extraction of a cork.

Another aspect of the present invention is the control of the corkscrew to prevent the corkscrew from reverse spiraling out of the cork during the application of upwardly directed forces, and independently of the screw carrier.

One embodiment of the present invention comprises a cork extractor for extracting a cork from a container comprising a support, a screw carrier movably connected to said support for vertical movement relative to said support, means for vertically moving said screw carrier relative to said support; a screw head rotatably connected to said screw carrier; a corkscrew connected to said screw head; a nut block, a spring and a rotation control, wherein said nut block, spring and rotation control are vertically movable relative to said support; said nut block comprising a helical passage adapted to receive said cork screw whereby vertical movement of said cork screw through said passage imparts spiral motion to said cork screw; said spring disposed between said nut block and said rotation control for biasing said rotation control vertically away from said nut block; said rotation control and said screw head comprising engageable structures to prevent rotation of the corkscrew relative to a cork while a cork is being extracted from a container.

Another embodiment of the present invention comprises a cork extractor comprising a support, a corkscrew movable relative to said support along a first axis; a drive mechanism for moving said corkscrew; and a handle for imparting force to said drive mechanism, said handle rotatable about a second axis which is generally perpendicular to said first axis, said handle comprising gripping portions on generally opposite sides of said second axis.

Another embodiment of the present invention comprises a cork extractor comprising a support, a plurality of racks movably connected to said support, said racks comprising gears and selectively movable in two directions, at least one movable drive gear which engages said racks such that movement of said at least one drive gear causes synchronous movement of said racks; and a screw carrier, connected to said racks, a corkscrew connected to said screw carrier and disposed generally between at least two of said racks.

As used herein the term "cork" is used to refer to corks comprising either natural cork or synthetic materials.

BRIEF DESCRIPTION OF THE DRAWINGS

FIGS. 9-17 are sectional views along line C-C of the cork extractor of FIG. 1 wherein:

FIG. 9 shows the cork extractor positioned on a bottle prior to insertion of the corkscrew.

FIG. 10 illustrates the corkscrew imbedded in the cork and the screw head engaging the rotation control.

FIG. 11 illustrates the screw head fully engaged with the rotation control.

FIG. 12 illustrates the cork partially extracted from the bottle.

FIG. 13 illustrates the cork fully extracted from the bottle.

FIG. 14 illustrates the cork extractor with the bottle removed and the cork positioned for extraction from the corkscrew.

FIG. 15 illustrates the screw head disengaged from the rotation control.

FIG. 16 illustrates the corkscrew partially removed from the cork.

FIG. 17 illustrates the cork extractor after removal of the cork

DETAILED DESCRIPTION

Figure 3:
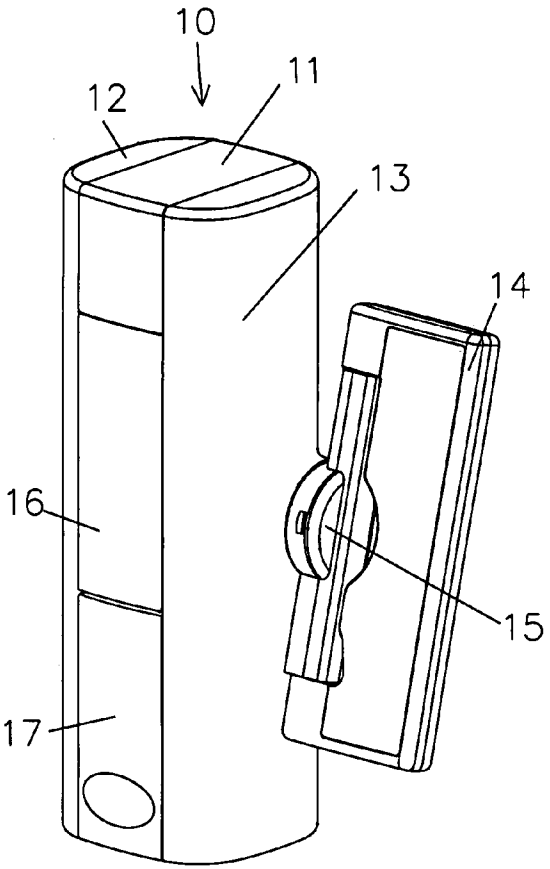
FIG. 3 is a perspective view of the cork extractor of FIG. 1 with the handle rotated counterclockwise almost 360 degrees.
Figure 2:
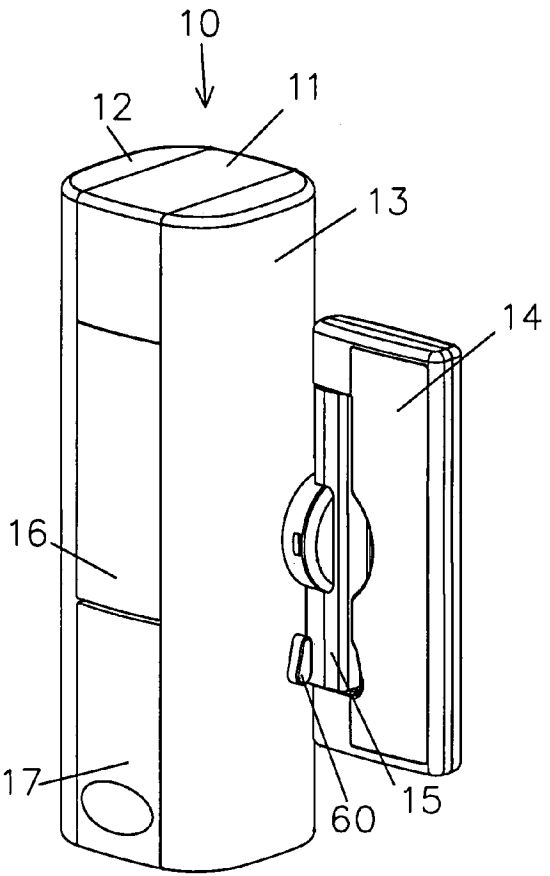
FIG. 2 is a perspective view of the cork extractor of FIG. 1 with the handle in the operating position.
Figure 1:
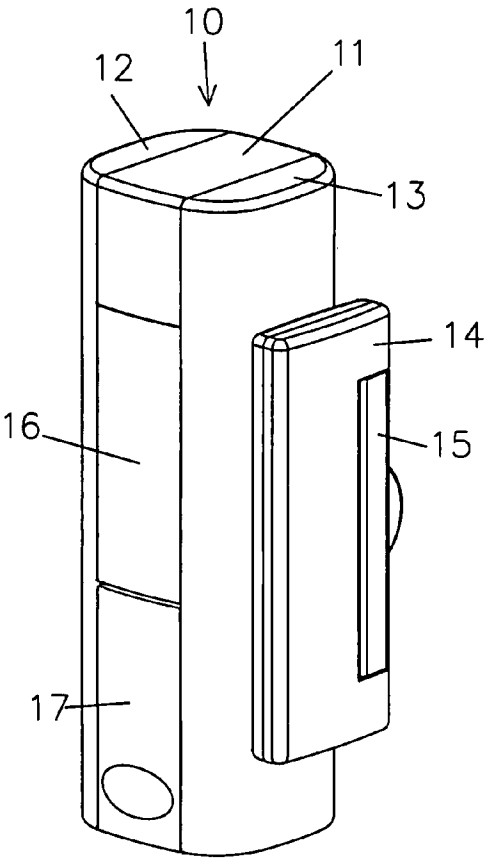
FIG. 1 is a perspective view of one embodiment with the handle in the storage position.

The Figures illustrate two embodiments of the present invention. FIGS. 1-3 are perspective views of one embodiment of a cork extractor with a handle in various positions. FIG. 1 illustrates a cork extractor 10 comprising a foil cutter 11, a left cover 12, a right cover 13, a handle 14 supported on a handle mount 15, a mounting support 16 and a rear latch 17. The handle 14 of cork extractor 10 is designed to be folded into a storage position proximate right cover 13 to advantageously minimize storage space. In this storage configuration, the gripping surfaces of handle 14 extend generally perpendicular to the rotational axis of the handle.

FIG. 2 illustrates cork extractor 10 with handle 14 unfolded to its operative position. FIG. 2 also illustrates a stop 60 positioned on right cover 13 which limits the rotational movement of the handle mount 15 and, consequently, the handle 14 during use. As will be described in further detail below, with the handle 14 in the configuration shown in FIG. 2, the corkscrew is positioned above the cork so that it is ready to be buried into a cork. Handle 14 is also in the position shown in FIG. 2 after a cork has been extracted from a bottle, and after the cork has been extracted from the cork extractor 10.

FIG. 3 illustrates handle 14 after being rotated almost a full rotation. A stop 60 (shown in FIG. 2) is designed to stop rotation of handle 14 after the handle has been rotated almost 360 degrees. As best shown in FIG. 3, the upper arm of the handle mount 15 does not extend as close to the surface of the right cover 13 as the lower arm of handle mount 15. Thus when the arm of handle mount 15 which is in the upper position in FIG. 3, as well as FIG. 2, is rotated through the lower position, stop 60 allows the handle mount 15 and handle 14 to continue rotating. Handle 14 is in the position shown in FIG. 3 when the corkscrew is in the extended position after the corkscrew has been buried into a cork, and when the corkscrew is extended for extracting the corkscrew from the cork.

Figure 4:
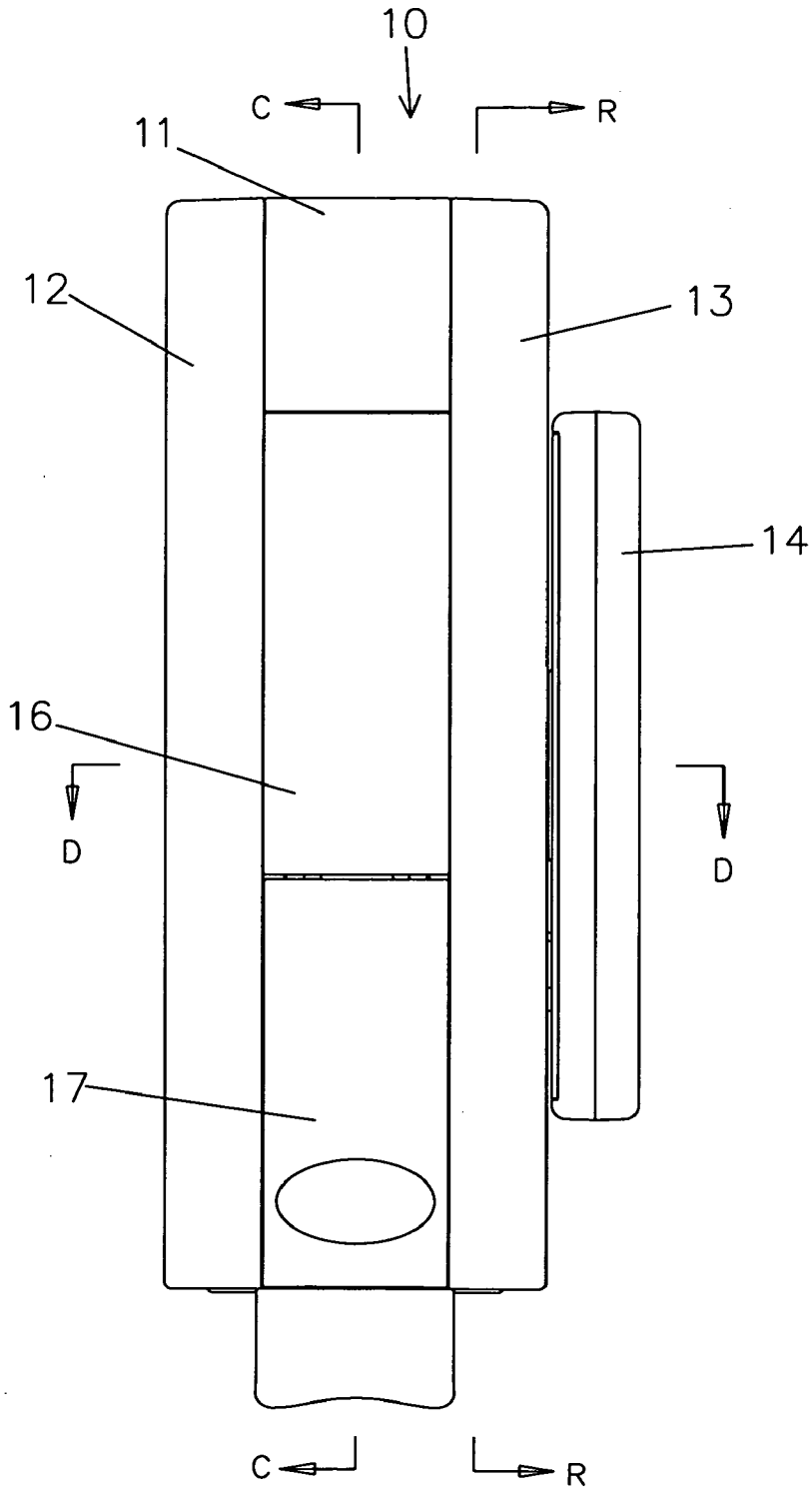
FIG. 4 is a front view of the cork extractor of FIG. 1.

FIG. 4 is a front view of the cork extractor 10. FIG. 4 also illustrates various sectional planes referred to below in connection with FIGS. 7-17.

Figure 5:
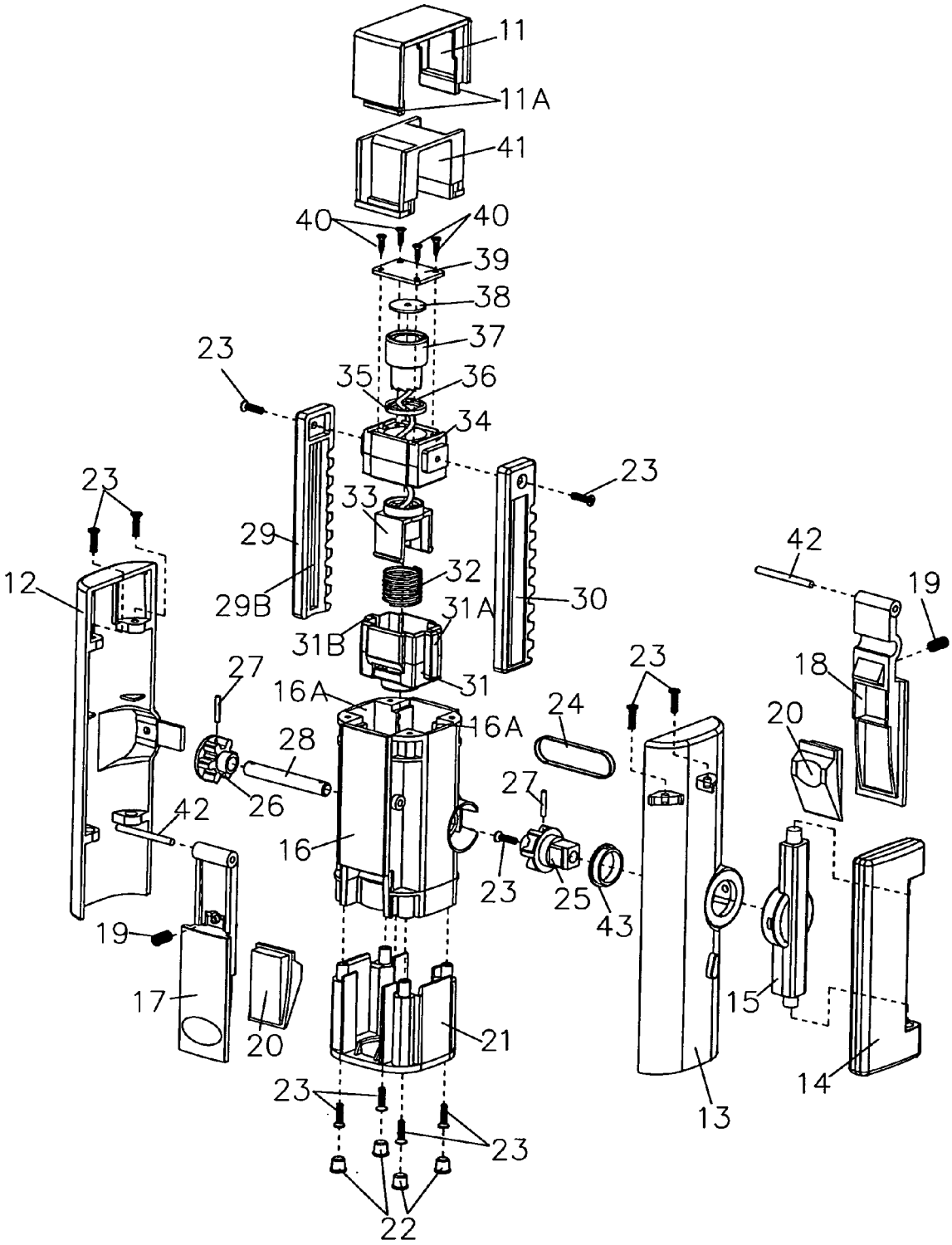
FIG. 5 is an exploded view of the cork extractor of FIG. 1.

FIG. 5 is an exploded view of the components of the embodiment illustrated in FIG. 1. In this illustrated embodiment, the various elements are connected either directly or indirectly to the mounting support 16. This illustrated embodiment comprises a foil cutter 11 which is removably connected to top cover 41 via latches 11A. Foil cutter 11 advantageously comprises sharp edges (not shown) which facilitate removal of the sealing foil, for example the sealing foil on a new bottle of wine. FIG. 5 illustrates left cover 12, right cover 13, handle 14, handle mount 15, a rear latch 17 and a front latch 18. Each of rear latch 17 and front latch 18 are pivotally connected to the inside of mounting support 16 and are biased inwardly by latch spring 19. Each latch is also advantageously provided with a non-slip grip, such as a rubber grip 20, for gripping a bottle during cork removal. This embodiment also comprises a bottom cover 21 which is secured to mounting support 16 with screws 23 which are in turn covered by screw covers 22.

In order to facilitate personalization, such as when the cork extractor is provided as a gift or when given away as a premium promotional product, a nameplate 24 is also advantageously provided on the assembled left cover 12 and right cover 13.

Figure 6:
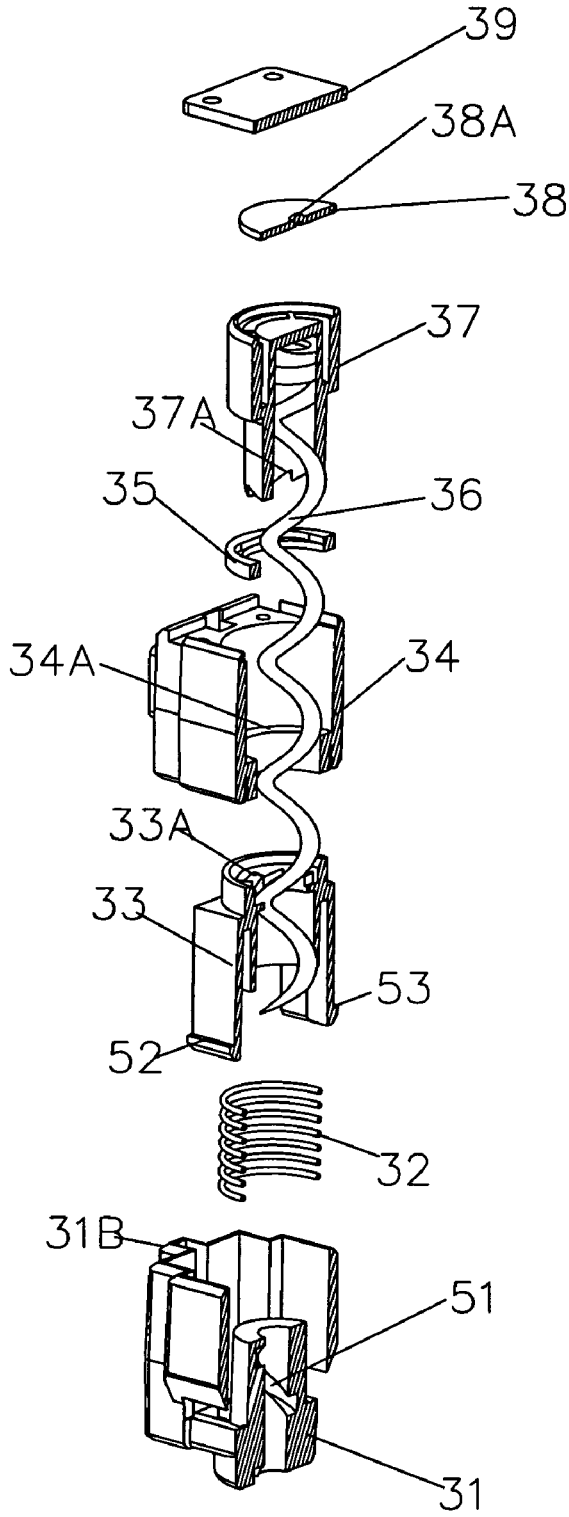
FIGS. 6 and 6A are partial, exploded, sectional views of the cork extractor of FIG. 1.
Figure 6A:
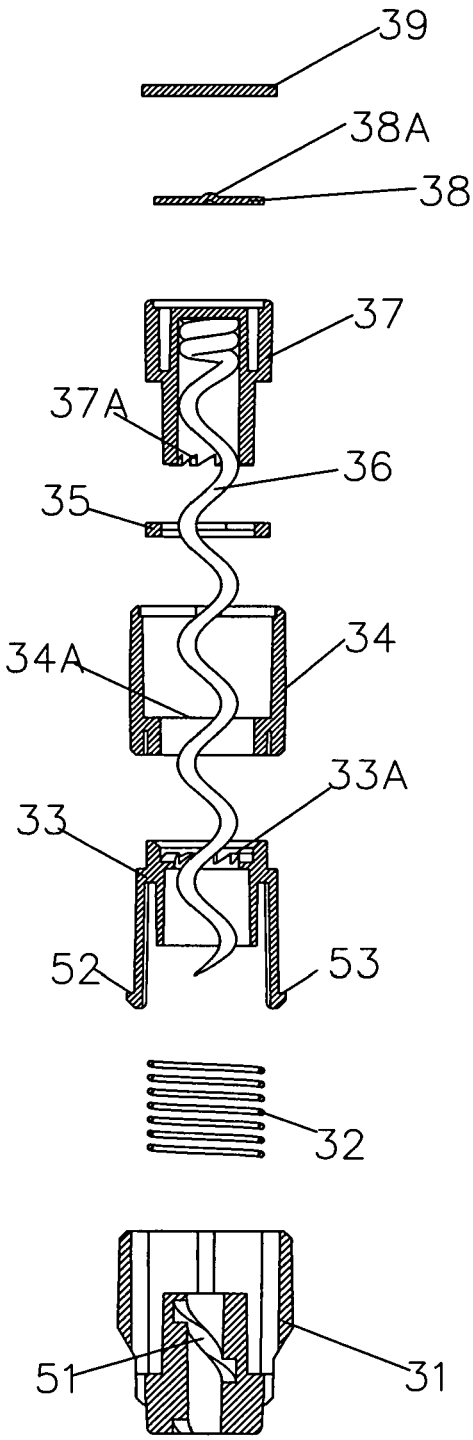

As best shown in FIG. 6 which is a sectional view of elements 31-39 along section line C-C of FIG. 4, corkscrew 36 is secured within a screw head 37, which is rotatably mounted within a screw carrier 34. A head cover 38 is provided over screw head 37 and is held in place by a carrier cover 39. Carrier cover 39 is secured to the screw carrier 34 by a plurality of screws 40 (shown in FIG. 5). A screw bearing 35 rests on an internal shoulder 34A of screw carrier 34. As best shown in FIG. 6A, head cover 38 comprises a raised dome 38A which is preferably generally rounded and raised slightly above the top, generally planar surface of head cover 38 to engage the bottom surface of carrier cover 39 and facilitate the free rotation of screw head 37 within screw carrier 34.

Additionally, with reference to FIGS. 5 and 6, a nut block 31, a control spring 32 and a rotation control 33 are positioned below screw carrier 34. For purposes of reference, the terms "up" and "down" are used herein to refer to the position and relative movement of various elements when the cork extractor is positioned for removing a cork from a bottle which is positioned vertically (upright). While the illustrated embodiment utilizes a coil spring to bias rotation control 33 vertically relative to nut block 31, other structures can be used in place of a coil spring.

Corkscrew 36 is secured within screw head 37, e.g. with an adhesive, such as via epoxy bonding. The lower portion of screw head 37 comprises a sawtooth edge 37A designed for engagement with a complementary sawtooth edge on an upwardly facing surface 33A of the spring-biased, rotation control 33 on nut block 31. Nut block 31 comprises a helical passage 51 which will impart a spiral motion to corkscrew 36 when corkscrew 36 is driven downwardly (or upwardly) through nut block 31. The sawtooth edges 37A on screw head 37 and the sawtooth edges 33A on rotation control 33 are angled to permit clockwise rotation of screw head 37 (as viewed from above) relative to rotation control 33 when screw head 37 first contacts rotation control 33 during the downward movement of the corkscrew 36. It will be appreciated that rotation control 33 has some limited downward resiliency due to the resiliency of control spring 32. Since nut block 31 is also secured to support 16 through rack 29 and rack 30, neither nut block 31 nor rotation control 33 are free to rotate. This arrangement permits screw head 27 and corkscrew 36 to rotate in a clockwise direction during the initial downward movement until screw head 37 is firmly seated on rotation control 33. At this point, the substantially vertical edges of the sawtooth structures 37A and 33A impede relative rotation of screw head 37 and rotation control 33. This prevents corkscrew 36 from rotating (counterclockwise) out of a cork when an upwardly force is applied to screw carrier 34. While the surfaces of each tooth of the illustrated sawtooth structures meet at well defined edges, e.g. the top portions of sawtooth structures 33A, these portions can also be formed with flat tops or rounded tops.

As explained in greater detail below, during operation nut block 31 is movable vertically with respect to both mounting support 16 and screw carrier 34. With reference to FIG. 5 and FIG. 8, nut block 31 is provided with a right protrusion 31A and a left protrusion 31B which move freely within slots 30A and 29B of right rack 30 and left rack 29, respectively. The cross-sectional view of FIG. 7 also shows right protrusion 31A of nut block 31 and slot 30A of right rack 30.

The driving vertical motion imparted to screw carrier 34 is achieved by translating the rotational force applied to handle mount 15 from handle 14 through a right pinion 25 and left pinion 26 which are connected via a connection pin 28 and pinion pins 27. Right pinion 25 drives a right rack 30 while left pinion 26 drives a left rack 29 vertically relative to mounting support 16. Rotation of handle mount 15 relative to right cover 13 is advantageously facilitated with a pinion bearing 43. The vertical movement of left rack 29 and right rack 30 are guided by linear guideways 16A in mounting block 16.

Figure 7:
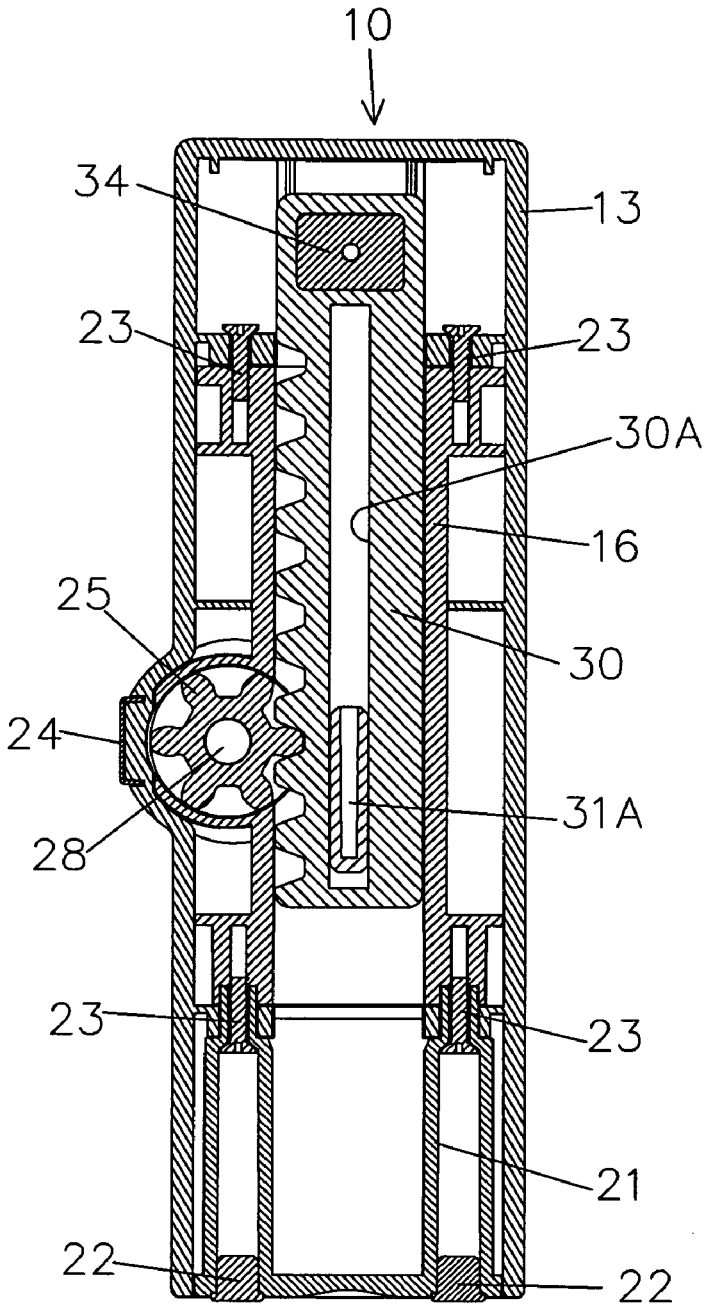
FIG. 7 is a sectional view along lines R-R of FIG. 5.
Figure 8:
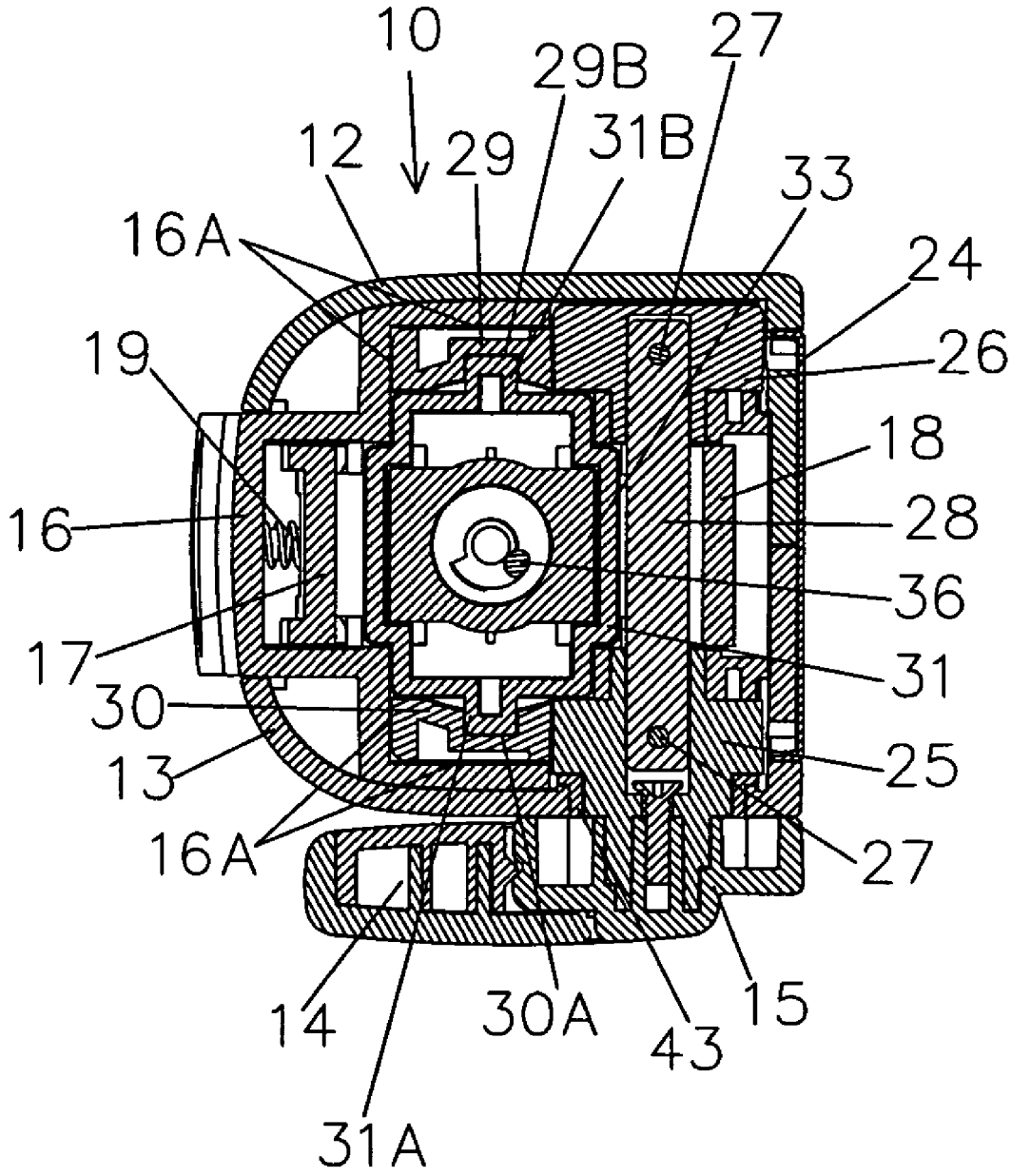
FIG. 8 is a sectional view along line D-D of FIG. 5.

As shown in FIG. 7 which is a cross-sectional view of the cork extractor along section line R-R, rotation of right pinion 25 causes the pinion teeth to engage the complementary teeth of right rack 30 causing vertical movement of the rack relative to support 16, while screw carrier 34 is able to move vertically relative to the nut block 31. As shown in FIG. 5, screw carrier 34 is secured proximate the top of left rack 29 and right rack 30 via fixing screws 23 so that vertical movement of the racks causes vertical movement of screw carrier 34. As noted above, movement of nut block 31 is guided by slots in each of the left rack 29 and right rack 30.

FIG. 8 is a cross-sectional view along sectional line D-D of FIG. 4.

Figure 9:
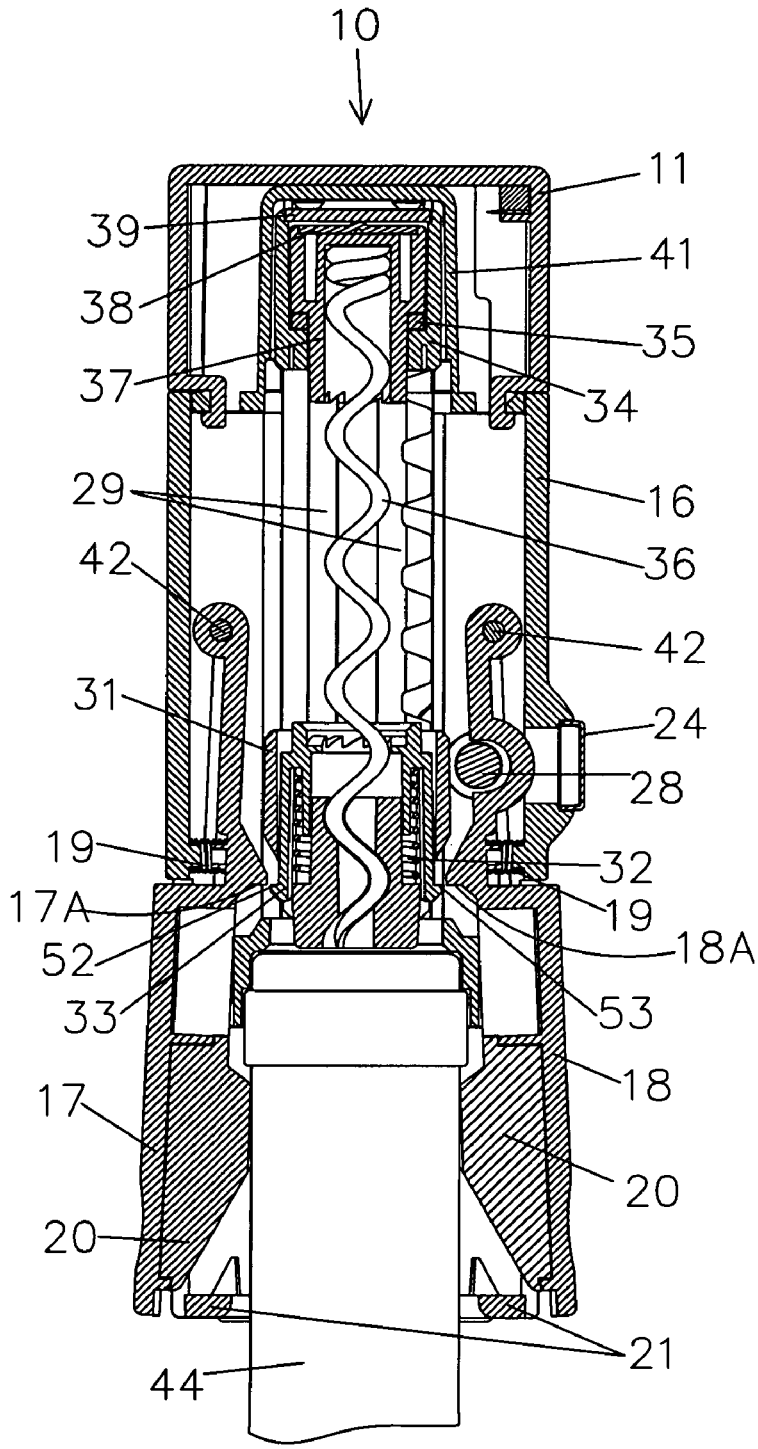

The operation and positions of the various components during various stages of cork removal operation are illustrated in FIGS. 9-17 which are cross-sectional views along section line C-C. FIG. 9 illustrates the initial position of the cork extractor 10 when it is placed over the top of a bottle 44 ( after removal of any foil). In this configuration, screw carrier 34 is positioned in an upper position so that the bottom of the corkscrew 36 rests upon the cork (not shown). Rubber grips 20 on rear latch 17 and front latch 18 rest upon the side of bottle 44. In this position, downwardly facing shoulders 17A and 18A are clear of the rear anchor ledge 52 and the front anchor ledge 53 of rotation control 33. Thus, in this configuration, the latches will not prevent the rotation control 33 from moving upwardly.

Figure 10:
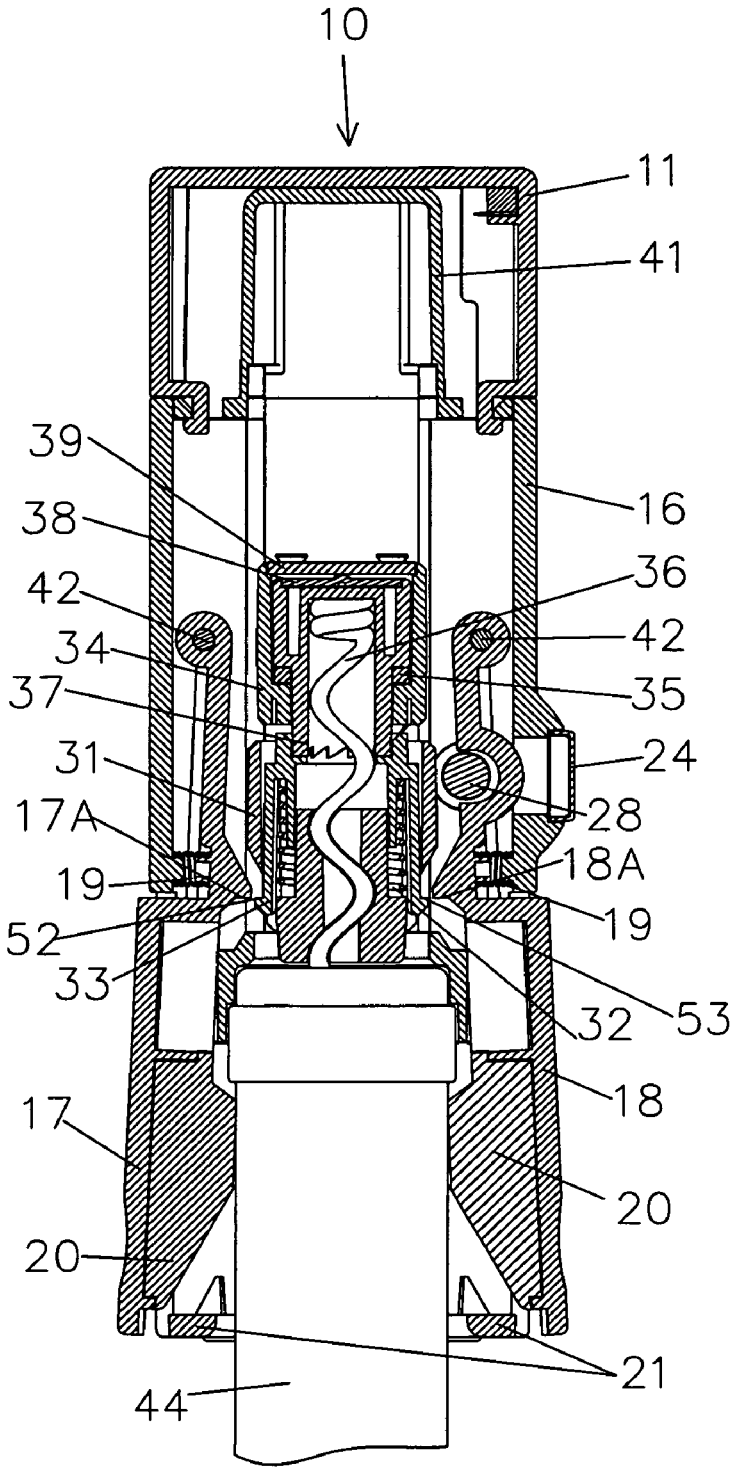

FIG. 10 shows the cork extractor 10 with the screw carrier 34 having been lowered such that sawtooth edges 37A of screw head 37 engage the complementary sawtooth edges 33A of rotation control 33. In the position shown in FIG. 10, the control spring 32 has not yet been significantly compressed, therefore, screw head 37 and corkscrew 36 are still able to rotate relative to screw carrier 34. It will be appreciated that the downward movement of screw carrier 34 is accomplished by rotation of handle 14 in a counterclockwise direction. As screw carrier 24 is moved downwardly, the corkscrew 26 is forced through the spiral groove 51 in nut block 31. This imparts a spiraling motion to the corkscrew 36 and drives corkscrew 36 into cork 45. The downwardly directed force is transmitted through the carrier cover 39 to the corkscrew 36 through head cover 38 and screw head 37. The dome 38A reduces the rotational friction between carrier cover 39 and head cover 38.

Figure 11:
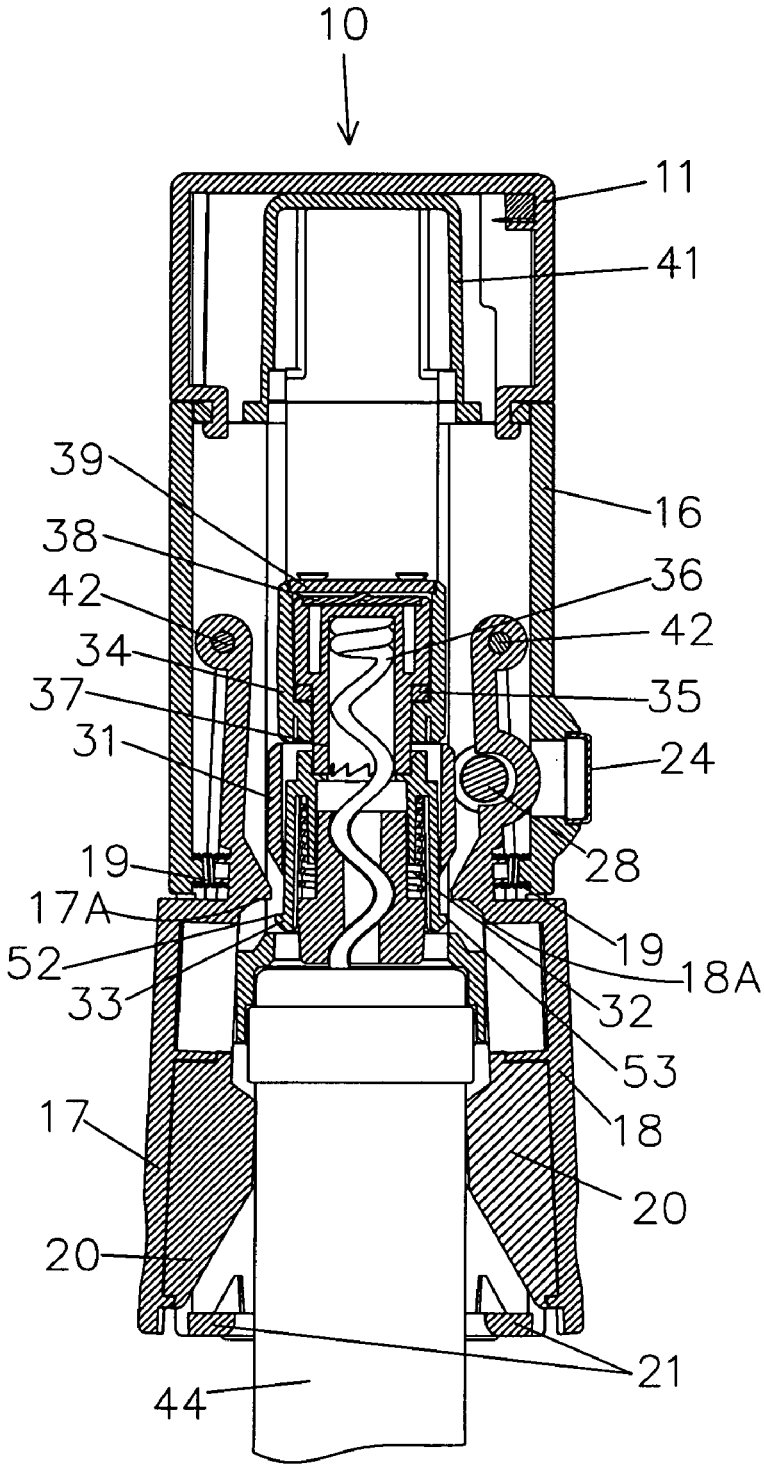

FIG. 11 illustrates the screw carrier 34 in a slightly lower position than that shown in FIG. 10. During the downward movement and prior to the screw head 37 reaching the position shown in FIG. 11, the sawtooth structures 33A of screw head and 33 of rotation control slip over each other as the rotation control 33 is pressed downwardly against the biasing force of control spring 32. When the screw carrier 34 reaches its lower limit illustrated in FIG. 11, the shape of the sawtooth structures 37A and 33A locks the screw head 37 and rotation control 33 from relative rotational movement in the opposite (counterclockwise) direction. Thus, when an upwardly directed force is applied to screw carrier 34 (by the reverse rotation of handle 14), nut block 31, control spring 22 and rotation control 33 are also drawn upwardly, since the corkscrew 36 is not free to rotate out of the cork 45.

Figure 12:
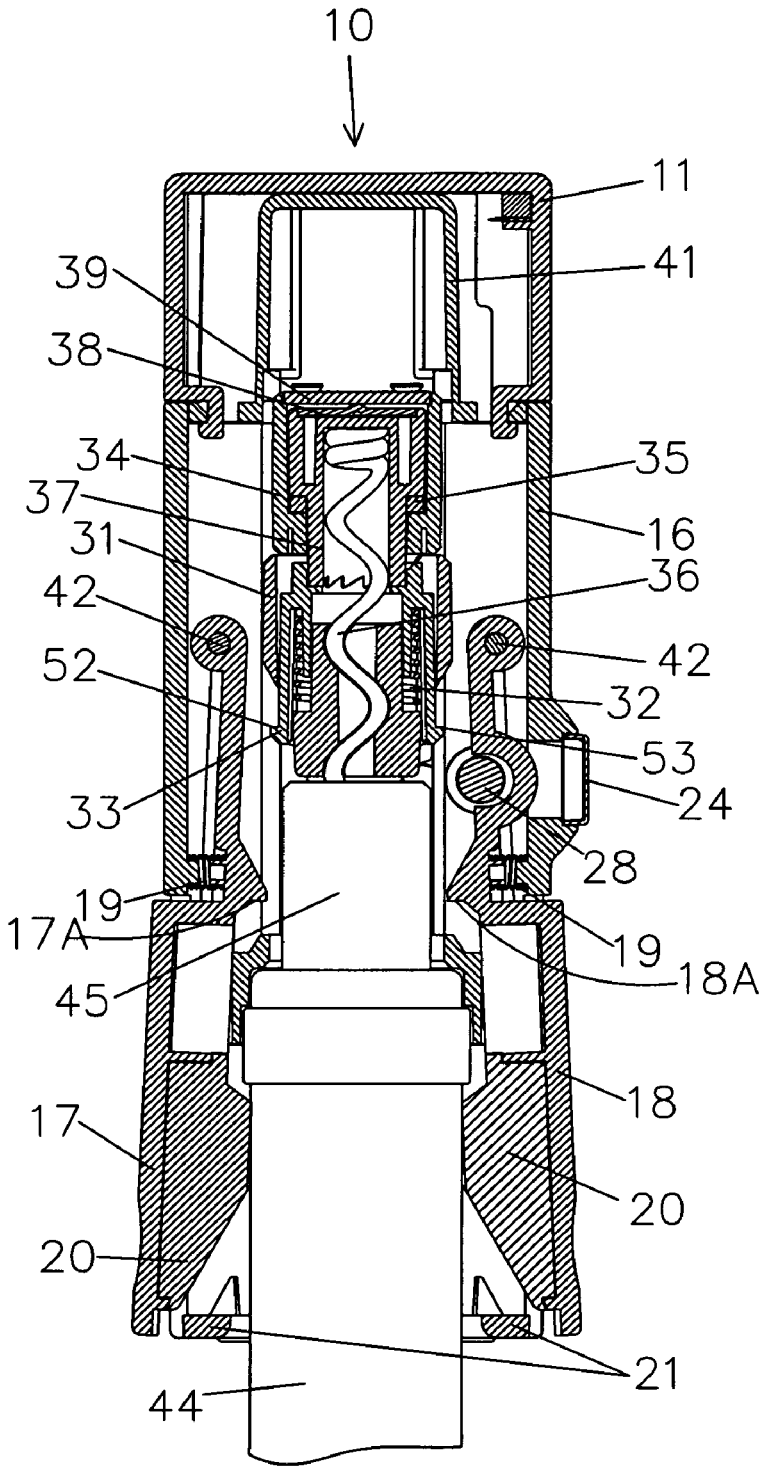

FIG. 12 illustrates the cork 45 partially removed from bottle 44 via the reverse rotation of handle 14 (not shown). Since rotation control 33 is clear of rear latch 17 and front latch 18, the rotation control 33, along with control spring 32 and nut block 31, moves upwardly with cork 45. The tendency of the corkscrew 36 to rotate counterclockwise and spiral out of cork 45 is prevented by the generally vertical surfaces of sawtooth structures 37A and 33A.

Figure 13:
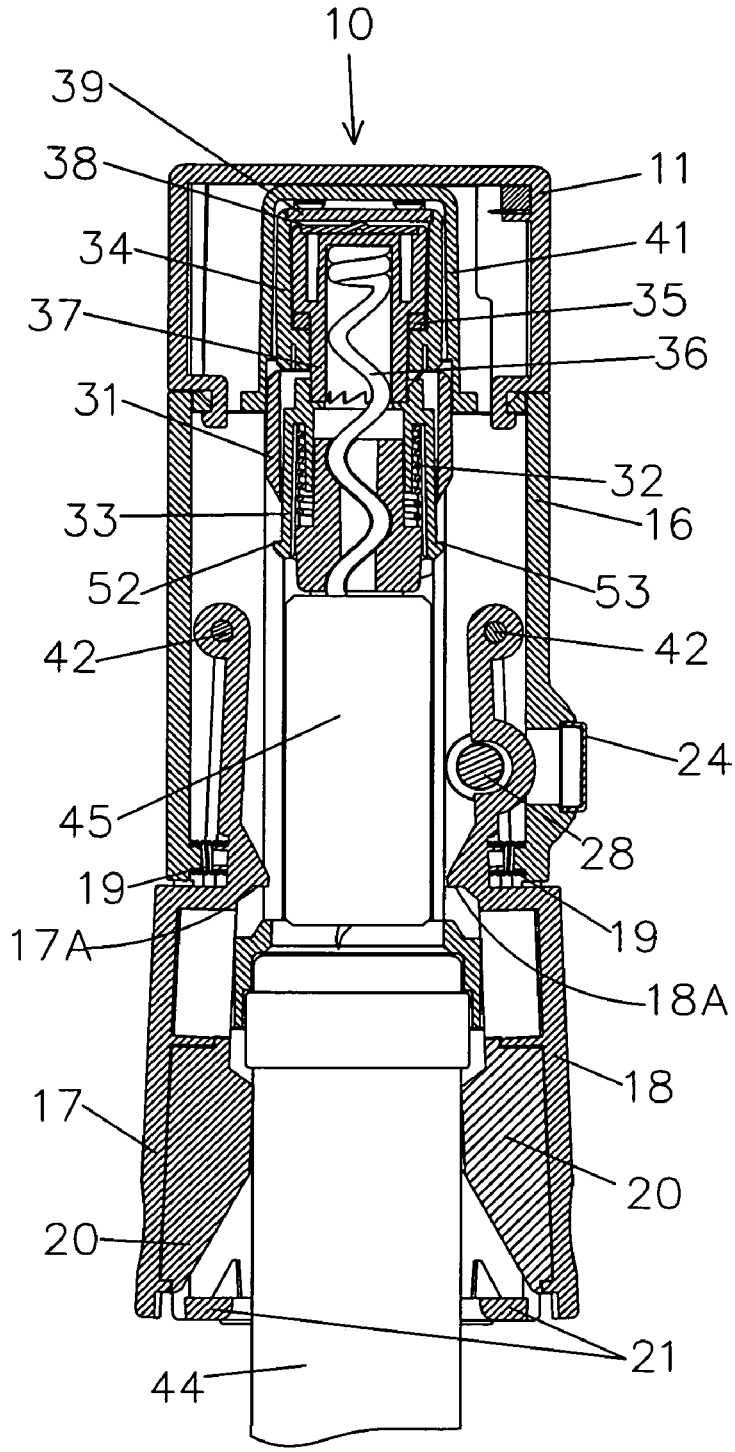

FIG. 13 is a similar view to FIG. 12 wherein continued upward movement of the screw carrier 34 has fully extracted cork 45 from bottle 44. With the cork 45 removed from the bottle 44, it is now desirable to extract the cork 45 from the cork extractor 10.

Figure 14:
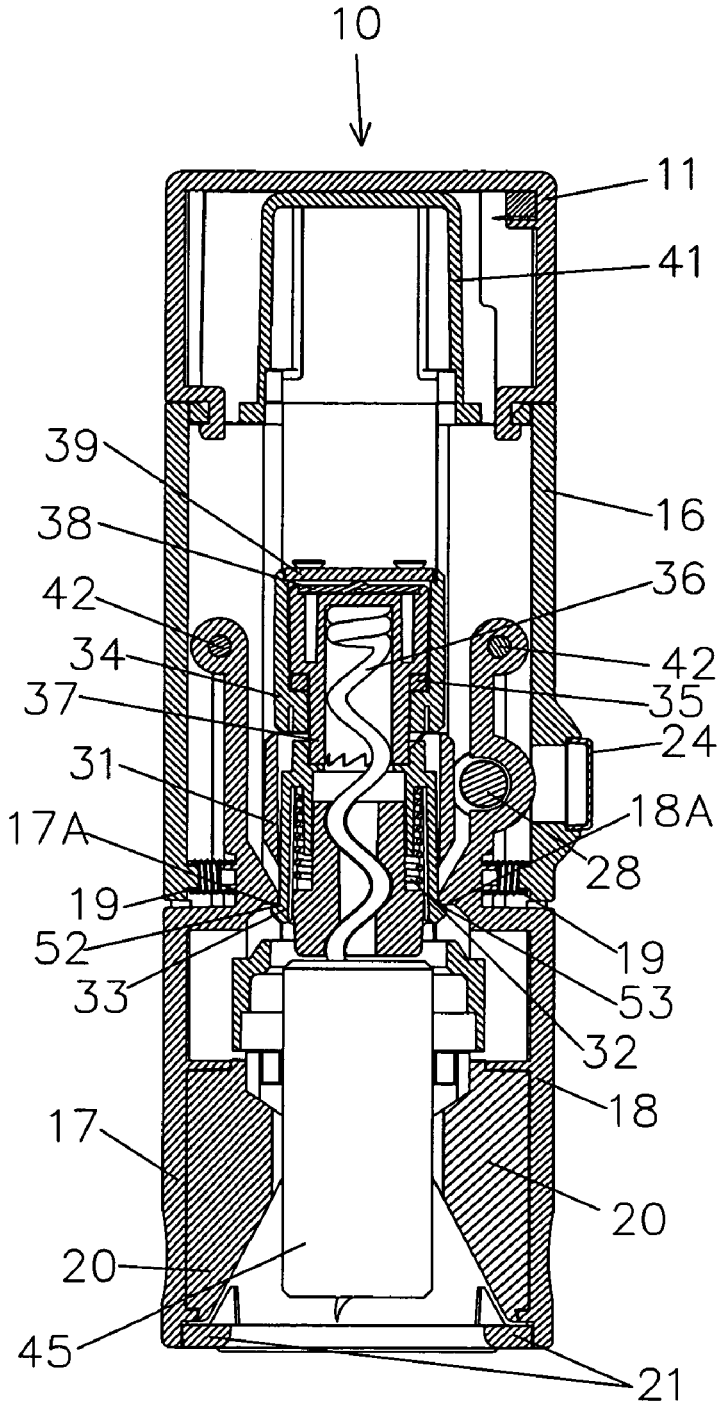

FIG. 14 shows the cork extractor 10 after the bottle 44 has been removed and with the screw carrier 34 moved back downwardly to a lower position. Upon removal of the bottle 44, rear latch 17 and front latch 18 are urged further inwardly by latch spring 19. In this position, the downwardly facing shoulders 17A and 18A engage the rear anchor ledge 52 and the front anchor ledge 53, respectively, preventing rotation control 33 from moving upwardly.

Figure 15:
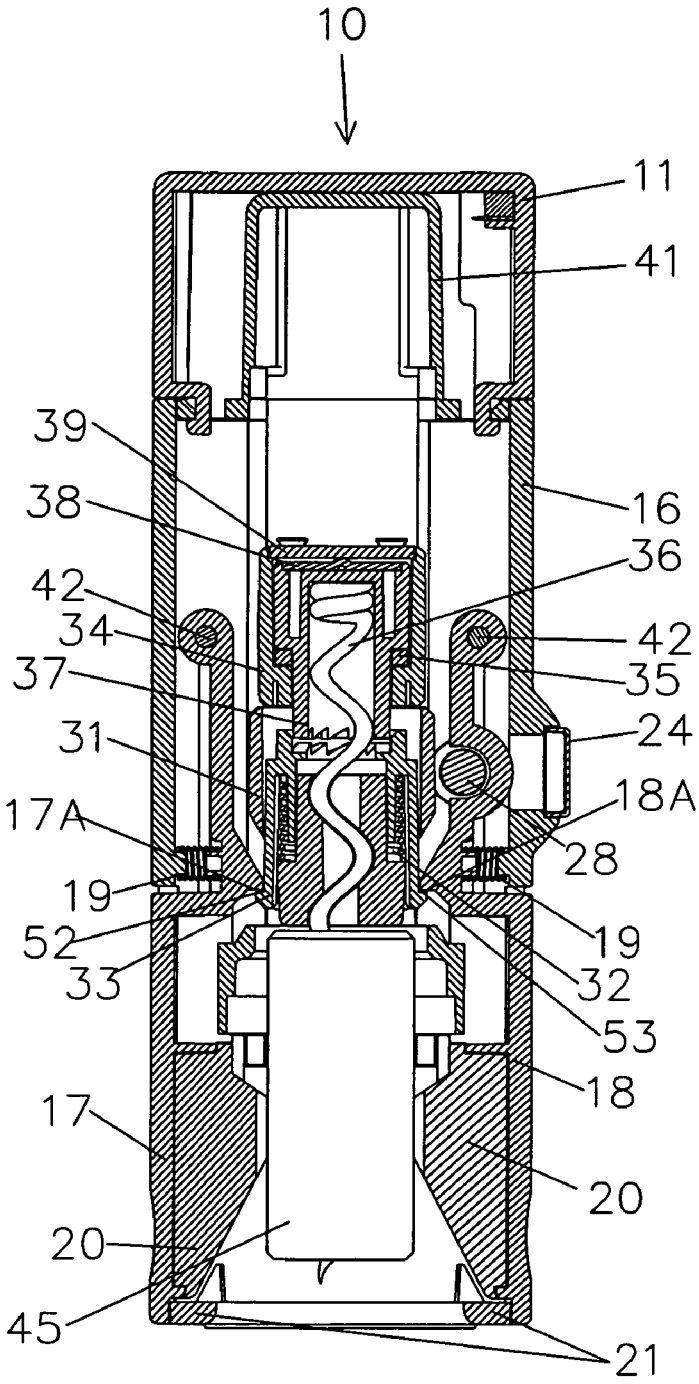

FIG. 15 shows the position of various components after the handle 14 (not shown) has been rotated to cause the screw carrier 34 to move slightly upwardly. Since rotation control 33 is prevented from moving upwardly, upward movement of screw carrier 34 causes the screw head 37, corkscrew 36, cork 35 and nut block 31 to move upwardly further slightly compressing the control spring 32 and thus disengaging the sawtooth structures 37A and 33A. Prior to this disengagement of the corresponding sawtooth structures, the corkscrew 26 was prevented from rotating out of cork 45. Once the sawtooth structures have disengaged, as shown in FIG. 15, the corkscrew 36 and screw carrier 37 are free to rotate thereby allowing the corkscrew 36 to rotate out of cork 45.

Figure 16:
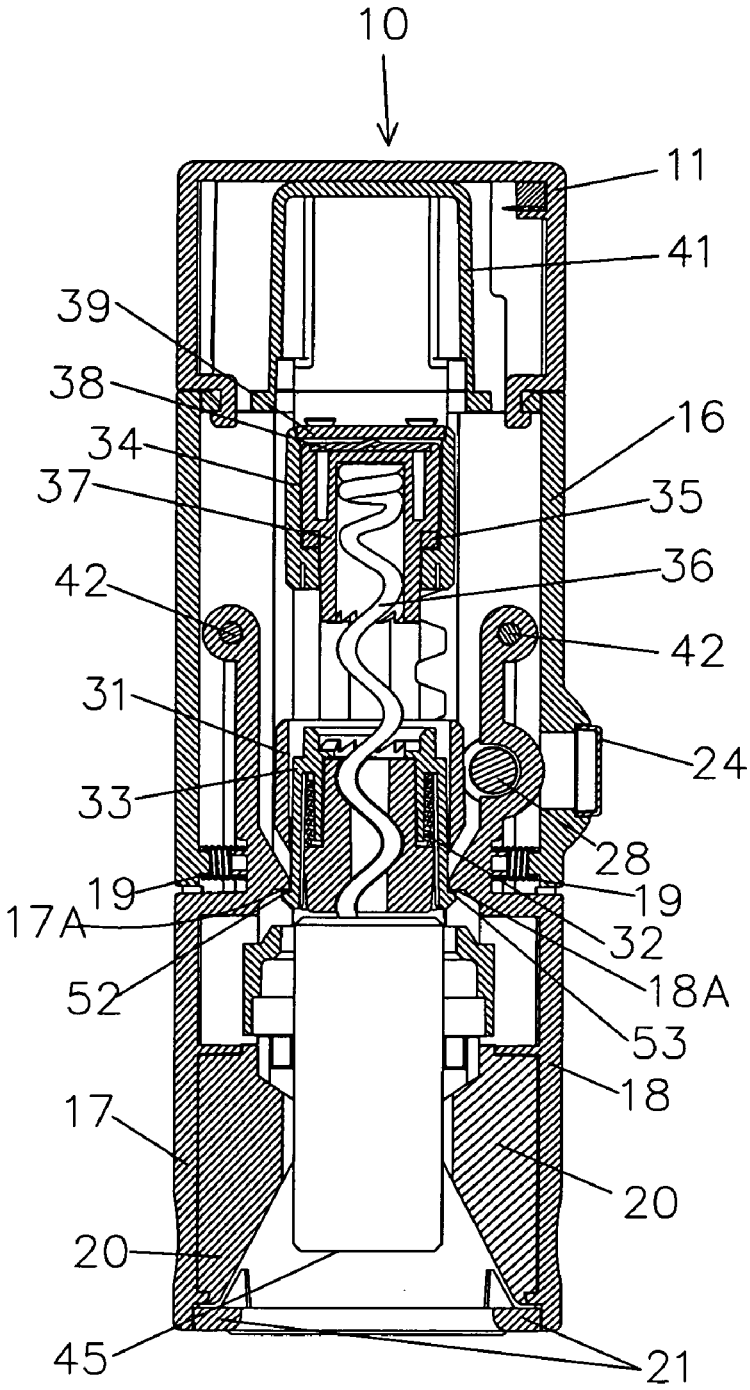

FIG. 16 shows the screw carrier 34, screw head 37 and corkscrew 36 extracted further from cork 45. Relative to the position shown in FIG. 15, further upward movement of the nut block 31 and cork 45 have been prevented by the rotation control 33 which is prevented from moving further upwardly by rear latch 17 and front latch 18. Thus, corkscrew 36 and screw head 37 are able to spiral in a counterclockwise direction out of the nut block 31 and cork 45 to the position shown in FIG. 16.

Figure 17:
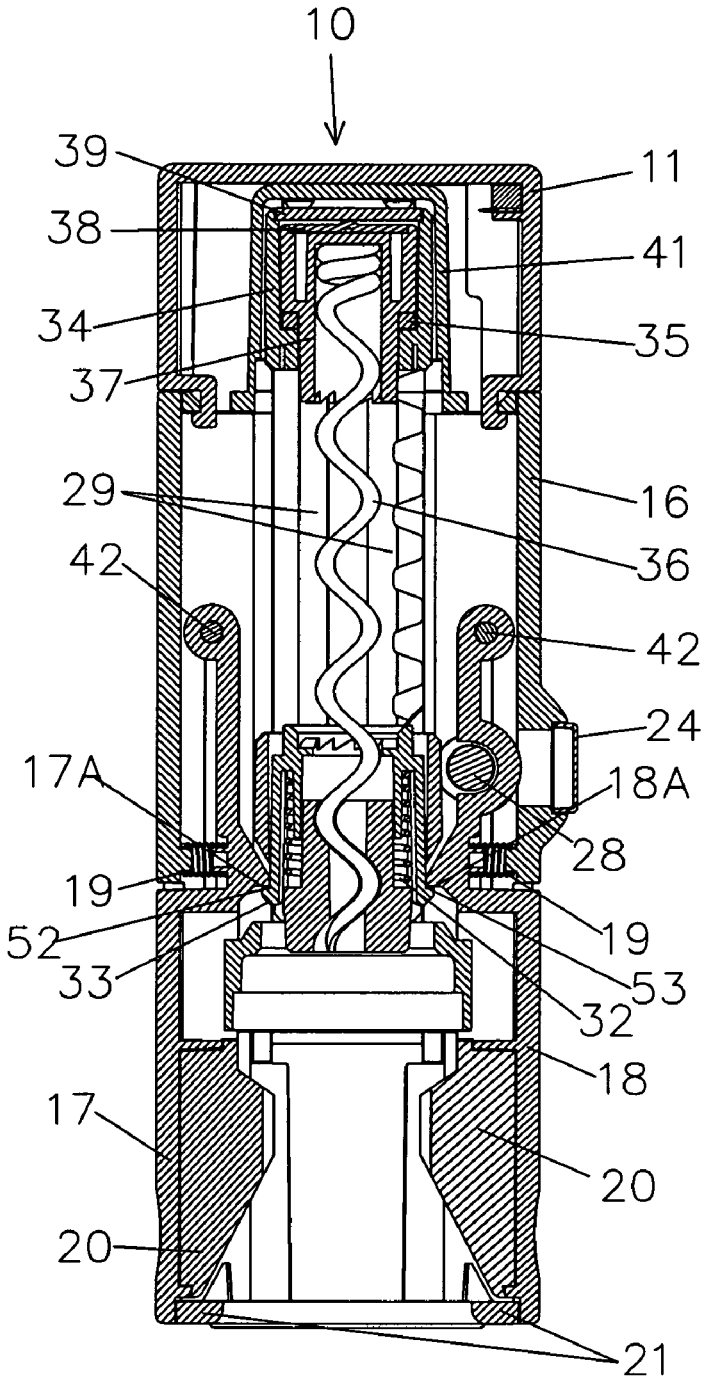

FIG. 17 shows the cork extractor 10 with the screw carrier 34, screw head 37 and corkscrew 36 returned to their upward position and with corkscrew 36 fully extracted from the cork 45. After the extracted cork 45 (not shown) is removed, the handle 14 can be folded and the unit is ready for storage.

Figure 6B:
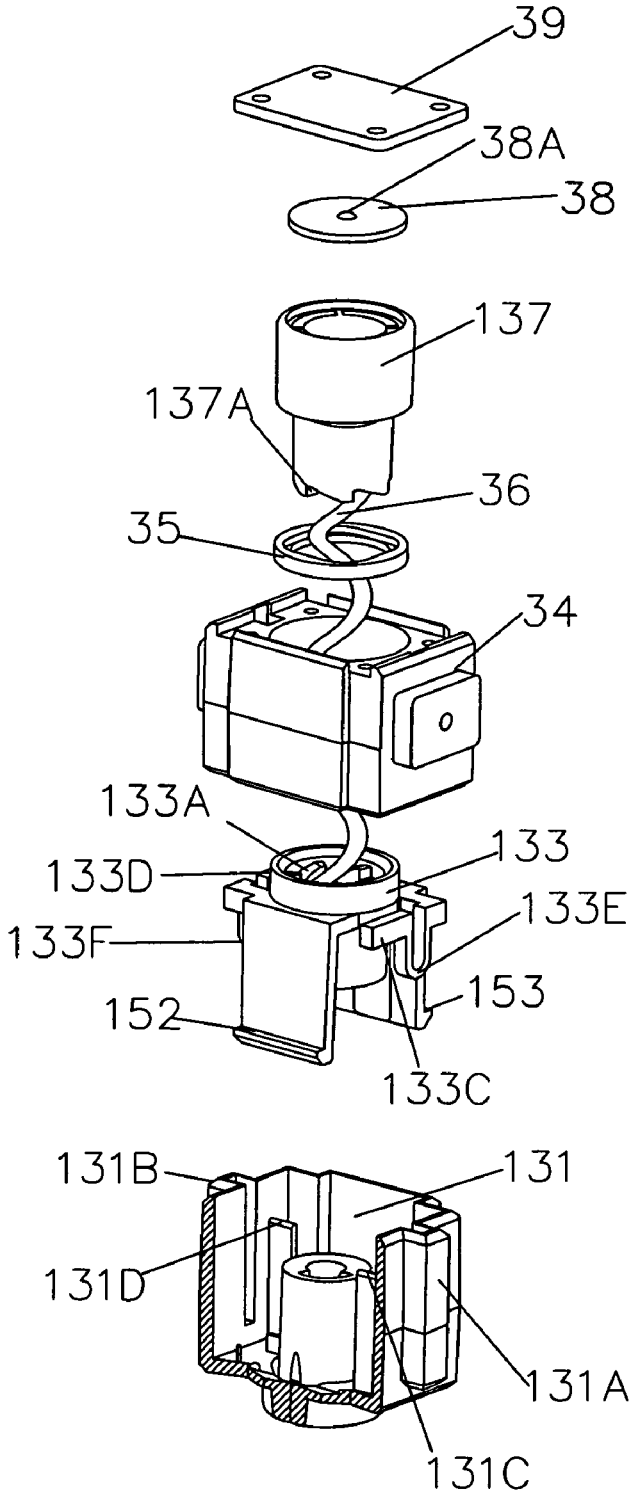
FIG. 6B is a partial, exploded view of an alternative embodiment of the present invention.

FIG. 6B illustrates portions of an alternative embodiment of the present invention. Only the elements which are different from those illustrated in the other figures have been renumbered. According to this embodiment of the present invention, screw head 137 comprises sawtooth structures 137A having flat tops. These "tops" are the lowermost surfaces of screw head 137 when in the position shown in FIG. 6B. Similarly, the tops of sawtooth structures 133A of rotation control 133 are also flat. Additionally, according to this embodiment of the present invention, different structure is used to bias rotation control 133 vertically relative to nut block 131. As illustrated in FIG. 6B, elastic members 133E and 133F comprising arms 133C and 133D, respectively, are connected to opposing sides of rotation control 133. According to this illustrated embodiment, these resilient arms are integrally formed with rotation control 133. When these components are assembled, arms 133E and 133F rest on the top edges of structures 131C and 131D in nut block 131. Therefore, as rotation control 133 is pressed downwardly relative to nut block 131, resilient arms 133C and 133D will yield to allow some relative vertical movement between rotation control 133 and nut block 131, but will tend to bias rotation control 133 upwardly thereby restoring rotation control 133 to its normal resting position after the force has been removed.

From the present description, it will be appreciated that the present invention advantageously provides a cork extractor comprising a screw carrier, a screw head rotatably connected to the screw carrier, and a nut block comprising a helical passage adapted to receive the corkscrew and to impart a spiral motion to the corkscrew. The present invention prevents the corkscrew from spiraling back out of the cork during cork removal independently of the screw carrier.

The present invention also provides a cork extractor comprising a support, a rotatable screw head and corkscrew movable along a generally vertical axis, and a handle for imparting driving force to the screw head/corkscrew having an axis of rotation generally perpendicular to the vertical axis of the corkscrew.

The various embodiments of the present invention provide several advantages compared to previously known cork extractors. Compared to cork extractors with lever actions, some embodiments of the present invention utilize couples which are easier to generate by hand and easier to balance due to their inherent directional consistency. The present design offers smooth operation requiring significantly less effort than previous designs and is therefore ideally suited for people not having strong hands. The use of couples provides a high degree of design freedom with respect to the mechanical parts so that applied stresses are more evenly distributed. This allows most of the parts of the cork extractor to be formed of injected plastic improving quality, consistency and cost competitiveness. The elimination of a lever allows the present design to be compact and easy to store without a special stand or box. The elimination of a lever also makes the overall operation simpler by reducing the number of steps required for a typical cork removal. With a lever type unit, since the movement of the corkscrew is synchronized with that of the lever, the lever usually has to be lifted up from its storage position before the unit is positioned over an unopened bottle. When a cork is expelled from a lever type unit (after the cork has been extracted from a bottle), the lever is usually in an extended position and must be lowered prior to storage. These two extra steps of raising the lever prior to commencing operation and folding the lever down following the step of expelling the cork are not required with the present invention. Storability and portability are further enhanced with the foldable handle.

Additionally, one embodiment of the present invention described herein comprises a plurality of racks which are driven by gears connected to the handle. The screw carrier is connected to the racks with the corkscrew generally disposed between at least two parallel racks. This aspect of the present invention provides an even distribution of the forces applied to the screw carrier, and hence to the corkscrew, during the various phases of the cork extraction process, i.e. during movement in different directions.

The invention claimed is:

1. A cork extractor for extracting a cork from a container comprising:

a support;

a screw carrier movably connected to said support for vertical movement relative to said support;

means for vertically moving said screw carrier relative to said support;

a screw head rotatably connected to said screw carrier;

a corkscrew connected to said screw head;

a nut block, a rotation control, and means for biasing said rotation control vertically away from said nut block; wherein said nut block, said biasing means and said rotation control are vertically movable relative to said support;

said nut block comprising a helical passage adapted to receive said cork screw whereby vertical movement of said cork screw through said passage imparts spiral motion to said cork screw;

said rotation control and said screw head comprising engageable structures to prevent rotation of the corkscrew relative to a cork while a cork is being extracted from a container.

2. A cork extractor according to claim 1 wherein said rotation control has limited vertical mobility relative to said nut block.

3. A cork extractor according to claim 1 wherein said engageable structures permit slippage and relative rotation in a first direction, and prevent relative rotation in a second direction.

4. A cork extractor according to claim 1 wherein said engageable structures are complementary engageable structures.

5. A cork extractor according to claim 1 wherein said engageable structures comprise sawtooth structures.

6. A cork extractor according to claim 5 wherein said rotation control is movably connected to said nut block.

7. A cork extractor according to claim 1 wherein said screw carrier translates along a first axis and said moving means comprises a handle rotatable about a second axis generally perpendicular to said first axis.

8. A cork extractor according to claim 7 wherein said handle comprises a gripping portion which extends through said second axis.

9. A cork extractor according to claim 7 wherein said handle comprises gripping portions on generally opposite sides of said second axis.

10. A cork extractor according to claim 1 wherein said moving means comprises a handle rotatable about an axis, wherein said handle comprises a gripping portion which extends through said axis.

11. A cork extractor according to claim 1 wherein said moving means comprises a handle rotatable about an axis, wherein said handle comprises gripping portions on generally opposite sides of said axis.

12. A cork extractor according to claim 1 wherein said screw carrier translates along a first axis, and said moving means comprises a handle rotatable about a second axis and gripping portions on generally opposite sides of said second axis.

13. A cork extractor according to claim 1 wherein said screw carrier translates along a first axis, and said moving means comprises a handle rotatable about a second axis, said handle selectively movable from an operating position to a storage position.

14. A cork extractor according to claim 13 said storage position is proximate said support.

15. A cork extractor according to claim 1 wherein said biasing means comprises a spring.

16. A cork extractor according to claim 1 further comprising means for restricting the movement of said nut block to facilitate removal of a cork from said corkscrew.

17. A cork extractor according to claim 16 wherein said nut block restricting means comprises at least one movable latch which engages said rotation control to restrict movement of said rotation control, thereby restricting vertical movement of said nut block.

18. A cork extractor according to claim 17 wherein said latch is pivotally connected to said support.

19. A cork extractor according to claim 18 further comprising means for biasing said latch inwardly toward said rotation control.

20. A cork extractor according to claim 17 wherein said nut block restricting means comprises at least two movable latches.

21. A cork extractor according to claim 16 wherein said nut block restricting means is ineffective when said cork extractor is positioned on a container.

22. A cork extractor according to claim 1 further comprising a foil cutter.

23. A cork extractor comprising:

a support;

a corkscrew movable relative to said support along a first axis;

means for driving said corkscrew into a bottled cork and withdrawing said corkscrew from a bottle to remove a cork;

a handle for imparting force to said means for driving and withdrawing said corkscrew, said handle both driving said corkscrew into a bottled cork and withdrawing said corkscrew from a bottle, said handle rotatable about a second axis which is generally perpendicular to said first axis, said handle comprising gripping portions on generally opposite sides of said second axis;

a screw carrier movably connected to said support for vertical movement relative to said support;

a screw head rotatably connected to said screw carrier;

said corkscrew connected to said screw head; and a nut block, a rotation control and means for biasing said rotation control vertically away from said nut block; wherein said nut block, said biasing means and said rotation control are vertically movable relative to said support;

said nut block comprising a helical passage adapted to receive said cork screw whereby vertical movement of said cork screw through said passage imparts spiral motion to said cork screw;

said rotation control and said screw head comprising engageable structures to prevent rotation of the corkscrew relative to a cork while a cork is being extracted from a container.

24. A cork extractor according to claim 23 wherein said rotation control has limited vertical mobility relative to said nut block.

25. A cork extractor according to claim 23 wherein said engageable structures permit slippage and relative rotation in a first direction, and prevent relative rotation in a second direction.

26. A cork extractor according to claim 23 wherein said engageable structures are complementary engageable structures.

27. A cork extractor according to claim 23 wherein said engageable structures comprise sawtooth structures.

28. A cork extractor according to claim 23 wherein said biasing means comprises a spring.

29. A cork extractor according to claim 28 wherein said spring is disposed between said nut block and said rotation control for biasing said rotation control vertically away from said nut block.

30. A cork extractor according to claim 23 further comprising means for restricting the movement of said nut block to facilitate removal of a cork from said corkscrew.

31. A cork extractor according to claim 30 wherein said nut block restricting means comprises at least one movable latch which engages said rotation control to restrict movement of said rotation control, thereby restricting vertical movement of said nut block.

32. A cork extractor according to claim 31 wherein said latch is pivotally connected to said support.

33. A cork extractor according to claim 31 further comprising means for biasing said latch inwardly toward said rotation control.

34. A cork extractor according to claim 30 wherein said nut block restricting means comprises at least two movable latches.

35. A cork extractor according to claim 30 wherein said nut block restricting means is ineffective when said cork extractor is positioned on a bottle.

36. A cork extractor according to claim 23 further comprising a foil cutter.

* * * * *